US009157606B2

(12) United States Patent
Garcia

(10) Patent No.: US 9,157,606 B2
(45) Date of Patent: Oct. 13, 2015

(54) OPTICAL SYSTEM FOR LEDS FOR CONTROL OF STRAY LIGHT

(75) Inventor: Joseph Garcia, San Antonio, TX (US)

(73) Assignee: KONINKLIJE PHILIPS N.V., Eindhoven (NL)

( * ) Notice: Subject to any disclaimer, the term of this patent is extended or adjusted under 35 U.S.C. 154(b) by 762 days.

(21) Appl. No.: 13/402,045

(22) Filed: Feb. 22, 2012

(65) Prior Publication Data

US 2013/0215612 A1 Aug. 22, 2013

(51) Int. Cl.

| | |
|---|---|
| ***F21V 1/00*** | (2006.01) |
| ***F21V 11/00*** | (2015.01) |
| ***F21V 5/00*** | (2015.01) |
| *F21Y 101/02* | (2006.01) |
| *F21Y 105/00* | (2006.01) |

(52) U.S. Cl.

CPC ..... *F21V 11/00* (2013.01); *F21V 5/007* (2013.01); *F21Y 2101/02* (2013.01); *F21Y 2105/001* (2013.01)

(58) Field of Classification Search

CPC ..... F21V 1/00; F21V 5/08; F21V 11/00; F21V 5/007; F21Y 2101/02; F21Y 2105/001

USPC ..... 362/248, 351

See application file for complete search history.

(56) References Cited

U.S. PATENT DOCUMENTS

| | | | | |
|---|---|---|---|---|
| 6,016,038 | A | 1/2000 | Mueller | |
| 6,211,626 | B1 | 4/2001 | Lys | |
| 6,948,838 | B2 * | 9/2005 | Kunstler | 362/545 |
| 7,731,409 | B2 * | 6/2010 | Nishimura | 362/613 |
| 8,157,414 | B2 * | 4/2012 | Schaefer et al. | 362/245 |
| 8,356,916 | B2 * | 1/2013 | Gordin et al. | 362/249.02 |
| 2008/0130309 | A1 * | 6/2008 | Condon et al. | 362/520 |
| 2008/0273324 | A1 * | 11/2008 | Becker et al. | 362/237 |
| 2008/0273327 | A1 * | 11/2008 | Wilcox et al. | 362/267 |
| 2009/0262532 | A1 * | 10/2009 | Wilcox et al. | 362/248 |
| 2009/0310356 | A1 * | 12/2009 | Laporte | 362/239 |
| 2009/0323330 | A1 * | 12/2009 | Gordin et al. | 362/235 |
| 2010/0110671 | A1 * | 5/2010 | Gordin et al. | 362/228 |
| 2010/0195330 | A1 * | 8/2010 | Schaefer et al. | 362/237 |
| 2012/0008320 | A1 * | 1/2012 | Tu et al. | 362/235 |

FOREIGN PATENT DOCUMENTS

| | | | |
|---|---|---|---|
| CN | 101303819 | A | 11/2008 |
| JP | 2009076949 | A | 4/2009 |
| JP | 2010176031 | A | 8/2010 |

* cited by examiner

*Primary Examiner* — Mary McManmon
(74) *Attorney, Agent, or Firm* — Yuliya Mathis

(57) ABSTRACT

Methods and apparatus for an optical system for LEDs for control of light output from the LEDs. A plurality of optical pieces may be provided with each being over one or more LEDs and configured to direct a majority of light output from such one or more LEDs toward a desired illumination direction. A shield array may be placed over the optical pieces and include a plurality of openings each sized to at least partially receive one of the optical pieces and a plurality of blocking shields extending upward from and provided partially over one of the openings and one of the individual optical pieces. The blocking shields block stray light rays that are transmitted from one of the individual optical pieces in a backlight direction away from the desired illumination direction.

18 Claims, 8 Drawing Sheets

OPTICAL SYSTEM FOR LEDS FOR CONTROL OF STRAY LIGHT

TECHNICAL FIELD

The present invention is directed generally to an optical system for LEDs for control of light output from the LEDs. More particularly, various inventive methods and apparatus disclosed herein relate to an optical system having optical pieces and shields utilized to control light output from a plurality of LEDs.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

In certain lighting fixtures implementing LEDs there is motivation to limit or eliminate the amount of light from the LEDs that is directed from the lighting fixture to areas that are not intended to be illuminated. Motivations to limit such stray light from LEDs may include the desire to achieve compliance with one or more standards. For example, obtaining credit for Leadership in Energy and Environmental Design (LEED) certifications requires conforming to specified spill light levels in lighting layouts. Current designs directed at limiting the amount of stray light from LEDs may significantly reduce the efficiency of light directed at the intended illumination area. Current designs may additionally or alternatively fail to limit stray light to the degree necessary to achieve compliance with one or more standards such as compliance with requirements specified by LEED.

Thus, there is a need in the art to provide an optical system for LEDs for control of light output from the LEDs that optionally overcomes one or more drawbacks of some current designs.

SUMMARY

The present disclosure is directed to inventive methods and apparatus for an optical system for LEDs for control of light output from the LEDs. For example, a plurality of optical pieces may be provided, each being over one or more LEDs and configured to direct a majority of light output from such one or more LEDs toward a desired illumination direction. A shield array may be placed over the optical pieces and include a plurality of openings each sized to at least partially receive one of the optical pieces and a plurality of blocking shields extending upward from and provided partially over one of the openings and one of the individual optical pieces. The blocking shields block stray light rays that are transmitted from one of the individual optical pieces in a backlight direction away from the desired illumination direction.

Generally, in one aspect, an LED optical system placeable over top of an array of LEDs is provided and includes a plurality of optical pieces. Each of the optical pieces includes a free form LED cavity on a first side thereof and a free form protrusion on a second side thereof over the LED cavity. Each LED cavity is sized to receive at least a portion of at least one of the LEDs. Each of the optical pieces is configured to direct a majority of light output from a received of the LEDs in a desired illumination range toward a desired illumination direction. The LED optical system also includes a cohesive shield array placed over the optical pieces. The cohesive shield array includes a plurality of openings each sized to receive at least one of the optical pieces, an intermediary outward facing surface extending between the plurality of openings, and a plurality of blocking shields each extending upward from and provided partially over one of the openings and provided partially over one of the optical pieces. Each of the blocking shields includes an interior surface generally facing one of the optical pieces. Each interior surface is provided partially over one of the optical pieces opposite the illumination direction and blocks stray light rays transmitted generally opposite the illumination direction.

In some embodiments the interior surface is low reflectance. In some versions of those embodiments the interior surface is substantially black in color.

In some embodiments the intermediary outward facing surface of the cohesive shield array is low reflectance. In some versions of those embodiments the intermediary outward facing surface is substantially black in color.

In some embodiments each of the optical pieces is configured to redirect substantially all light output generated from a single of the LEDs received within a respective of the LED cavities in a single iso-illuminance distribution pattern. In some versions of those embodiments the iso-illuminance distribution pattern is an IES Type IV distribution pattern.

In some embodiments each of the optical pieces includes a total internal reflection prism protruding therefrom on a backside thereof opposite the illumination direction and the total internal reflection prism is positioned completely under one of the blocking shields.

In some embodiments each interior surface has a substantially arcuate cross-section as taken from a base thereof to an upper extent thereof.

In some embodiments each interior surface has a substantially flat upper portion partially overlaying a respective of the optical pieces.

Generally, in another aspect, an LED optical system placeable over top of an array of LEDs is provided and includes a plurality of optical pieces each configured for placement over at least one of the LEDs to redirect substantially all light output generated thereby in a single iso-illuminance distribution pattern generally toward a desired illumination direction. The LED optical system also includes a shield array placed over the optical pieces. The shield array includes a plurality of openings each sized to receive at least one of the optical pieces, an intermediary outward facing surface extending between the plurality of openings, and a plurality of blocking shields each extending upward from and provided partially over one of the openings and partially over one of the optical pieces. Each of the blocking shields includes an interior surface generally facing one of the optical pieces. Each interior surface is provided partially over one of the optical pieces opposite the illumination direction.

In some embodiments the intermediary outward surface of the cohesive shield array is low reflectance and substantially black in color.

In some embodiments each interior surface is low reflectance and substantially black in color.

In some embodiments each of the optical pieces includes a total internal reflection prism protruding therefrom on a backside thereof opposite the illumination direction and the total internal reflection prism is positioned completely under one of the blocking shields.

In some embodiments the optical pieces form a cohesive optical array that includes an optical array intermediary outward facing surface extending between the optical pieces. In some versions of those embodiments the optical array intermediary outward facing surface includes at least one alignment protrusion extending into a corresponding alignment notch provided in the outward facing surface of the shield array.

Generally, in another aspect, an LED lighting unit is provided that includes an array of LEDs and an array of optical pieces, each of the optical pieces positioned over at least one of the LEDs and redirecting substantially all light output generated thereby in a single iso-illuminance distribution pattern generally toward a desired illumination direction. The LED lighting unit also includes a cohesive shield array placed over the optical pieces. The cohesive shield array includes a plurality of openings each sized to receive at least one of the optical pieces, an intermediary outward facing surface extending between the plurality of openings, and a plurality of blocking shields each extending upward from and provided partially over one of the openings and partially over one of the optical pieces. Each of the blocking shields includes an interior surface generally facing one of the optical pieces. Each interior surface is provided partially over one of the optical pieces opposite the illumination direction and blocks stray light rays transmitted generally opposite the illumination direction.

In some embodiments each interior surface is substantially low reflectance.

In some embodiments the intermediary outward surface of the cohesive shield array is substantially low reflectance.

In some embodiments the optical pieces form a cohesive optical array that includes an optical array intermediary outward facing surface extending between the optical pieces. In some versions of those embodiments the optical array intermediary outward facing surface includes at least one alignment protrusion extending into a corresponding alignment notch provided in the outward facing surface of the shield array.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

In certain lighting fixtures implementing LEDs there is motivation to limit or eliminate the amount of light from the LEDs that is directed from the lighting fixture to areas that are not intended to be illuminated. Current designs directed at limiting the amount of stray light from LEDs may significantly reduce the efficiency of light directed at the intended illumination area. Current designs may additionally or alternatively fail to limit stray light to the degree necessary to achieve compliance with one or more standards. Thus, Applicants have recognized a need in the art to provide a LED lighting unit an optical system for LEDs for control of light output from the LEDs that optionally overcomes one or more drawbacks of some current designs.

More generally, Applicants have recognized and appreciated that it would be beneficial to provide methods and apparatus related to an optical system having optical pieces and shields utilized to control light output from a plurality of LEDs.

In view of the foregoing, various embodiments and implementations of the present invention are directed to an optical system for LEDs for control of light output from the LEDs.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatus and methods may be omitted so as to not obscure the description of the representative embodiments. Such methods and apparatus are clearly within the scope of the claimed invention. For example, aspects of the methods and apparatus disclosed herein are described in conjunction with particular distributions of LEDs on a LED board. However, one or more aspects of the methods and apparatus described herein may optionally be implemented in combination with other LED configurations (e.g., LEDs in an alternative distribution mounted directly to a heatsink) and implementation of the one or more aspects of an optical system described herein in combination with alternatively configured LED configurations is contemplated without deviating from the scope or spirit of the claimed invention.

Figure 1:
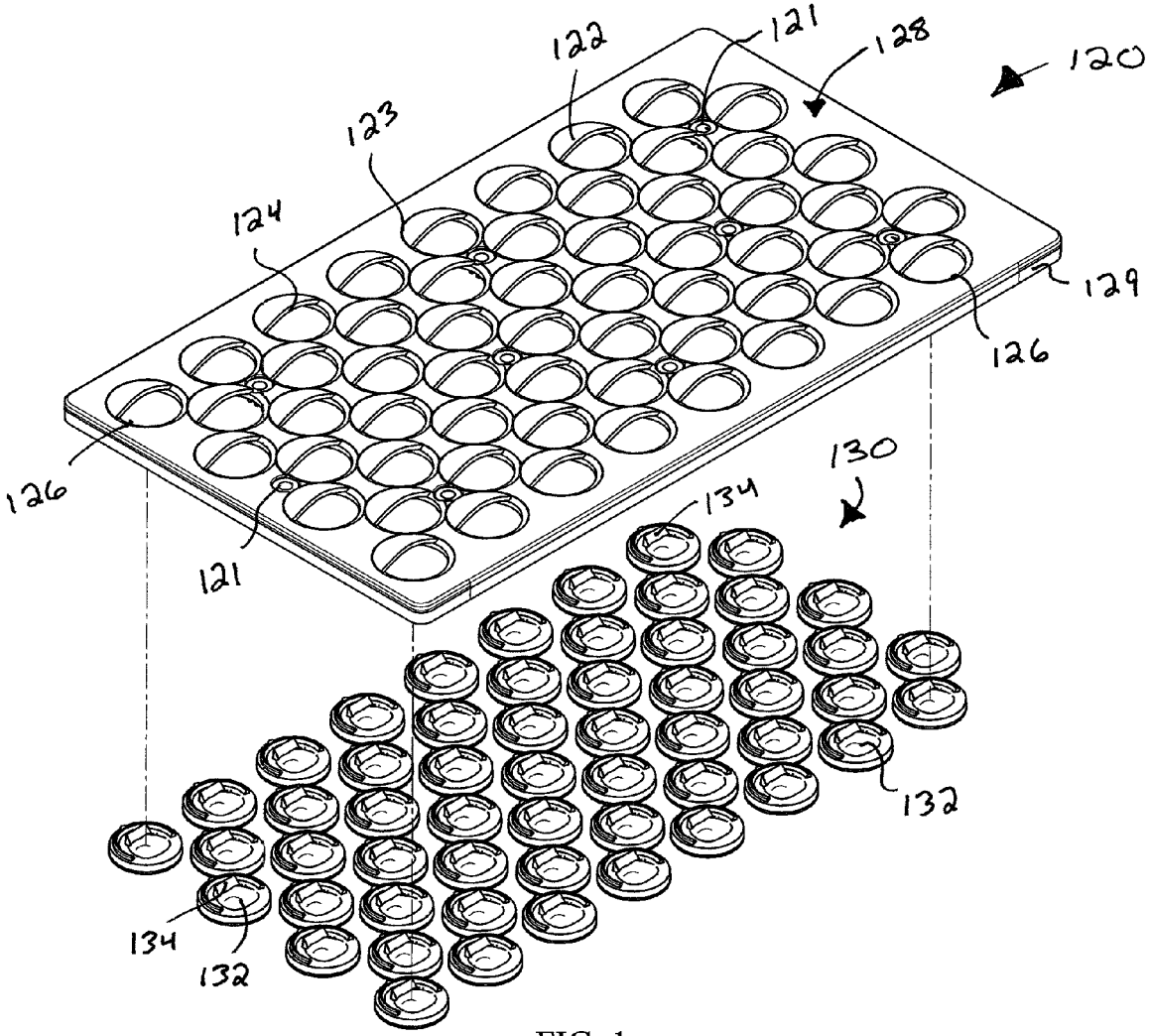
FIG. 1 illustrates a lower perspective view of an optical system of a first embodiment of a LED lighting unit with a single piece shield array of the LED lighting unit exploded away from an array of optical pieces of the LED lighting unit.
Figure 2:
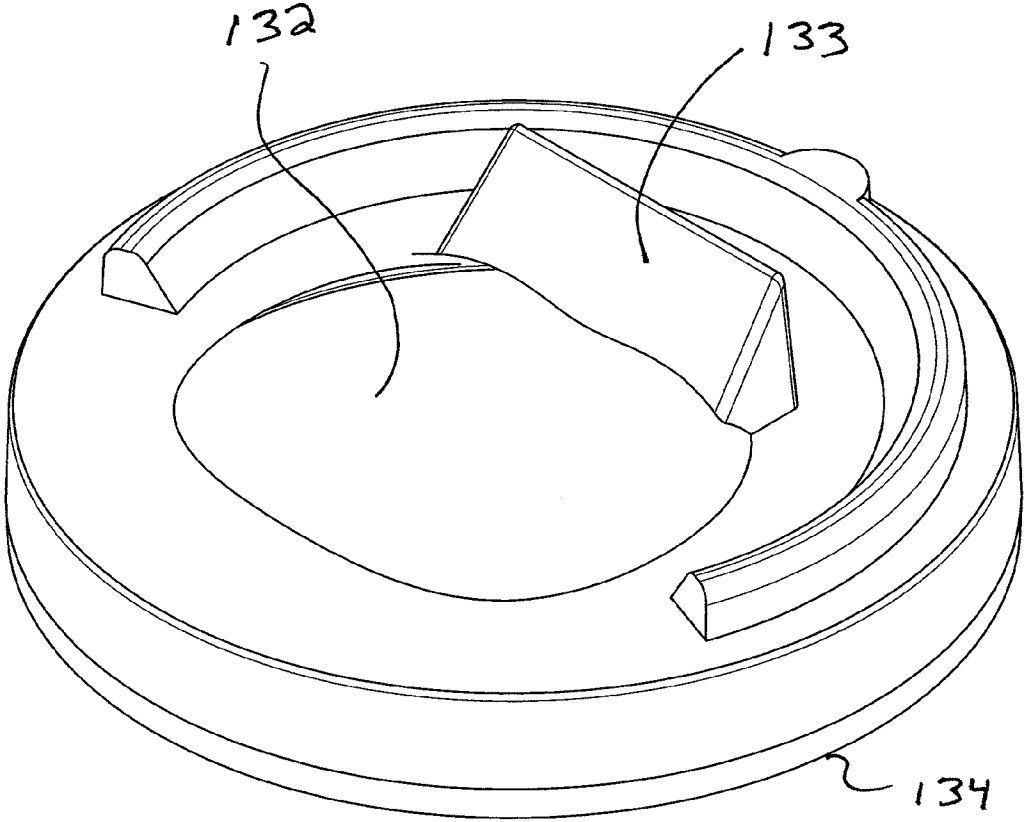
FIG. 2 illustrates a close-up lower perspective view of a single optical piece of the first embodiment of the LED lighting unit.
Figure 3:
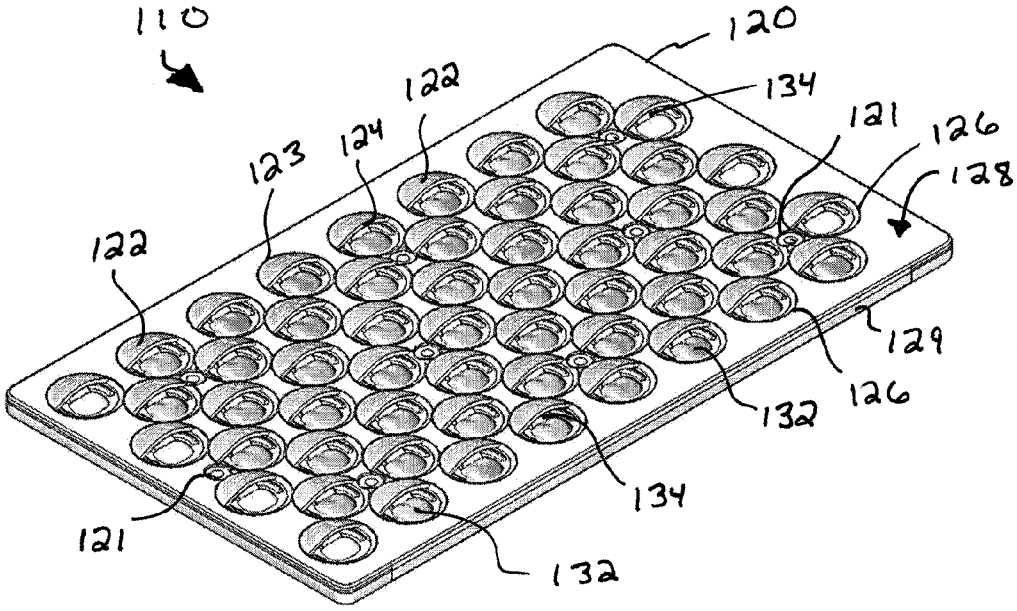
FIG. 3 illustrates a lower perspective view of the first embodiment of the LED lighting unit.
Figure 4:
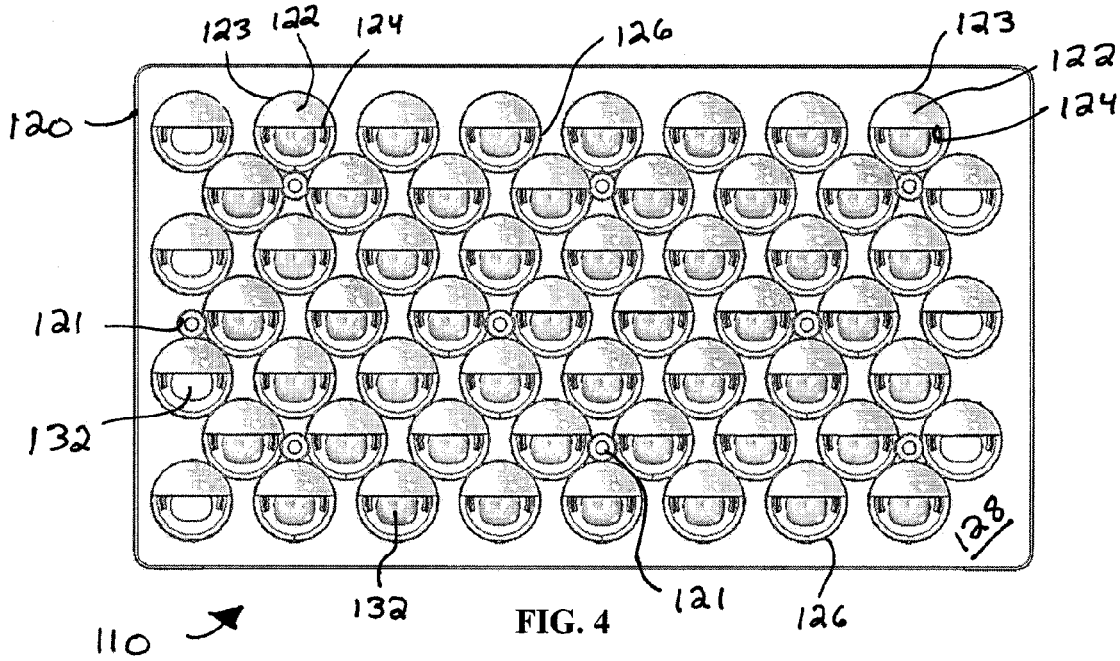
FIG. 4 illustrates a lower plan view of the first embodiment of the LED lighting unit.
Figure 5:
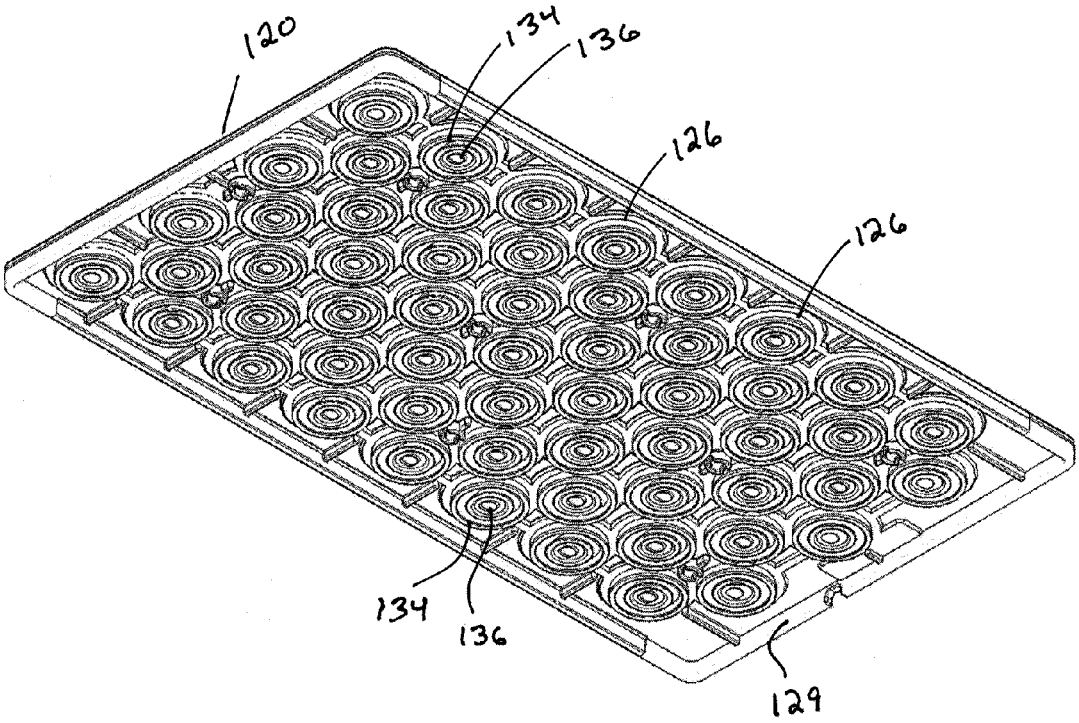
FIG. 5 illustrates an upper perspective view of the optical system of the first embodiment of the LED lighting unit.
Figure 6:
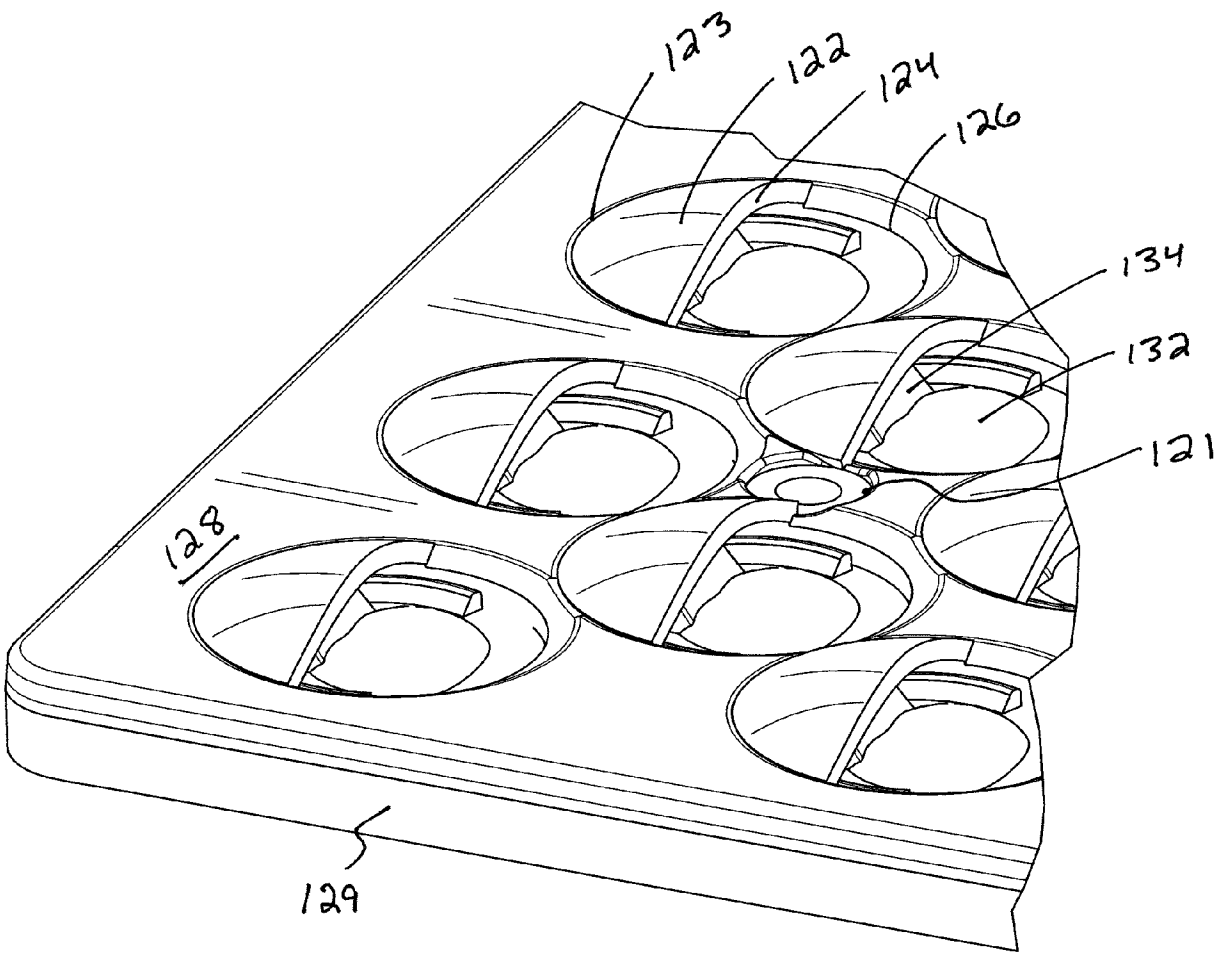
FIG. 6 illustrates a close-up lower perspective view of a portion of the first embodiment of the LED lighting unit.
Figure 7:
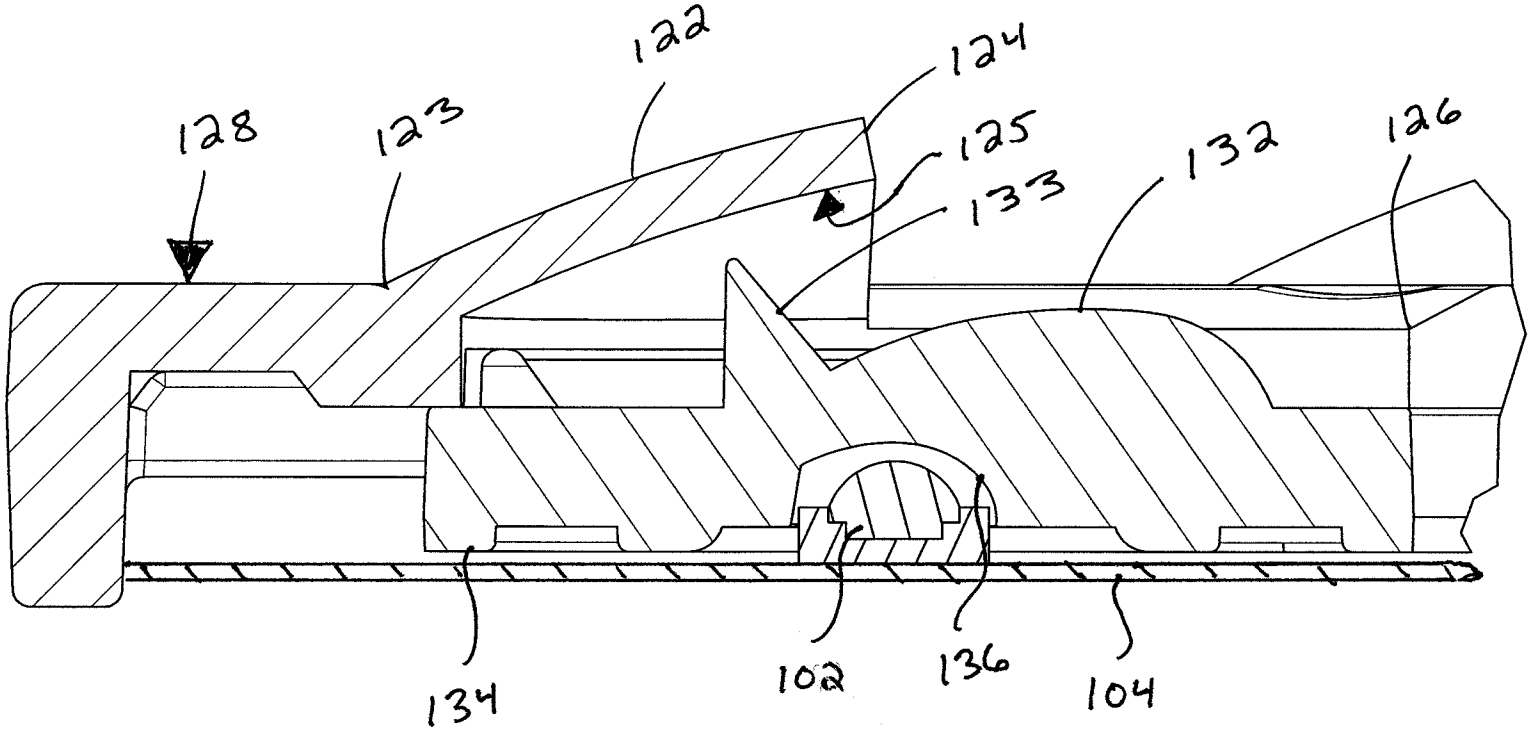
FIG. 7 illustrates a section view of a portion of the first embodiment of the LED lighting unit take along the section line 7-7 of FIG. 6.
Figure 8:
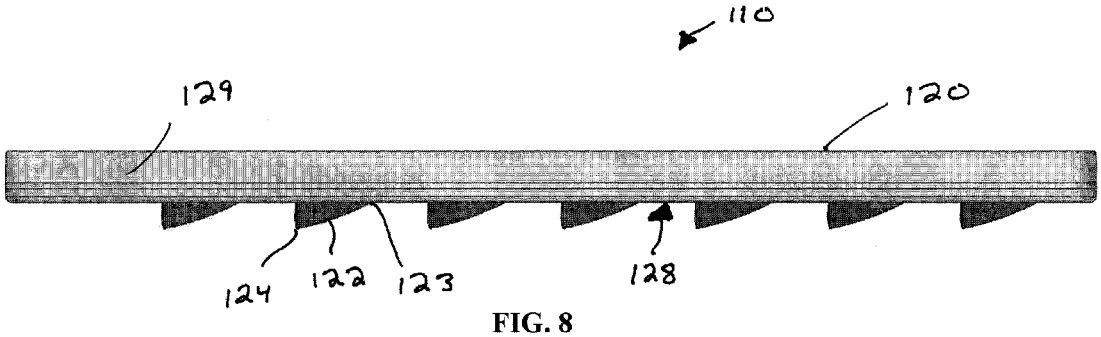
FIG. 8 illustrates a side view of the first embodiment of the LED lighting unit.

Referring to FIGS. 1 through 8, a first embodiment of a LED lighting unit 110 is illustrated. The LED lighting unit 110 includes an array of LEDs 102 mounted on a LED circuit board 104 (FIG. 7). An optical system of the LED lighting unit 110 includes a single piece shield array 120 and an array of optical pieces 130. The illustrated array of optical pieces 130 includes a plurality of individual optical pieces that may each be individually positioned and aligned over a single of the LEDs 102. In other embodiments one or more of the individual optical pieces may be cohesively formed with one another. The individual optical pieces each include a free form optic 132 and a rear total internal reflection (TIR) prism 133. In the illustrated embodiment the individual optical pieces each share a substantially common configuration. Also, each of the optical pieces is commonly oriented relative to a respective of the LEDs it is provided over so that each of the optical pieces directs light output from a LED it is provided over generally in the same illumination direction.

The free form optics 132 may be designed and populated in combination with the LEDs 102 to produce any desired distribution pattern. For example, the free form optics 132 may be designed to produce asymmetric full cut-off Illumination Engineering Society (IES) patterns such as IES Type II, III, and/or IV full cut-off patterns. As an example, in some embodiments each of the free form optics 132 may produce an IES Type II pattern. Each of the free form optics 132 is supported on a base 134 and includes a LED cavity 136 (FIGS. 5 and 7) on an inner facing side thereof. The LED cavities 136 are each positioned and sized to surround at least a portion of a single of a respective LED 102 (e.g., at least the light emitting die and/or light emitting epoxy casing) and direct light output therefrom through a respective free form optic 132 provided thereover. The LED cavities 136 may optionally receive at least a portion of a respective LED 102 therein. The illustrated LED cavities 136 have an arcuate profile on a side (e.g., generally the right side of FIG. 7) toward the desired illumination direction and a vertical profile on a side (e.g., generally the left side of FIG. 7) away from the desired illumination direction. The arcuate profile segment of the LED cavities 136 refracts a majority of light output from LED 102 directed thereto generally in the desired illumination direction. The vertical profile of the LED cavities 136 internally reflects a majority of light output from LED 102 directed thereto and directs such light output in the desired illumination direction.

Optical design of free form optics 132 for producing an IES Type IV pattern include shorter dimensions along an X axis and longer dimensions in a transverse Y axis to create more forward projection in the distribution. Optical design of free form optics 132 for producing an IES Type II pattern include longer dimensions in the X axis and shorter dimensions in the Y axis to create a more lateral projection in the distribution. Optical design of free form optics 132 for producing an IES Type III pattern will fall between the design for creating the IES Type II pattern and the design for creating the IES Type IV pattern. In the illustrated embodiment the LEDs 102 and optical pieces are arranged in seven columns of eight, with the columns having alternatingly aligned rows. In other words, the first, third, fifth, and seventh columns have rows aligned with one another and the second, fourth, and sixth columns have rows aligned with one another. In alternative embodiment irregular spacing, spacing with different patterns, and/or differing distances between LEDs 102 and optical pieces may be provided.

The specific curvature of the outer surface for each of the free form optics 132 may be selected based on a number of parameters such as the light output characteristics of the LEDs 102, the spacing of the LEDs 102, height constraints, the configuration of the LED cavities 136, and/or desired IES distributions. The surface profile of the outer surface for each of the free form optics 132 and/or of the inner surface of the free form optics 132 (e.g., the inner dome surface formed in the LED cavities 136) may optionally be designed in a ray tracing program and modified with weighting factors and multiple iterations to create the final free form shape of the optics 132.

Each TIR prism 133 is placed on a backside of a free form optic 132 on an opposite side from the illumination direction of the free form optic 132. Each TIR prism 133 internally reflects a majority of light from a respective of the LEDs 102 that is incident thereon back in the illumination direction. For example, some of the light output from one of the LEDs 102 will be transmitted through the free form optic 132 to the TIR prism 133 and internally reflected by the TIR prism 133 away from the TIR prism 133 in a direction back toward the desired illumination area. The LED recess 136, the free form optic 132, and the TIR prism 133 cooperatively work together to direct a substantial majority of light output generated by a LED 102 generally in the illumination direction. For example, the LED lighting unit 110 may be installed along the perimeter of a parking lot such that intermediary surface 128 is substantially perpendicular to nadir and the optical pieces are oriented to direct illumination toward the parking lot while minimizing any light directed peripherally of the parking lot perimeter. Each of the TIR prisms 133 may be positioned on a side of a respective of the free form optics 132 that is more distal the desired illumination area. Other potential implementations of lighting unit 110 include, for example, utilization in pedestrian pathway applications to limit house side light and installation along the perimeter of a parking garage to provide substantially zero line of sight from outside the garage of light emitting from the lighting unit 110.

Although a specific placement of specific optical pieces are illustrated herein, one of ordinary skill in the art, having had the benefit of the present disclosure, will recognize and appreciate that alternative and/or additional optical pieces may be designed to produce a desired light output and/or to interface with one or more particular LEDs. Moreover, differing placement of the optics illustrated herein and/or alternative optics may be utilized to achieve a desired light output and/or to interface with one or more particular LEDs. For example, in some embodiments if an LED is utilized that has substantially different light output characteristics it may be desirable to modify the free form optics 136 to continue to produce a desired IES distribution. Also, for example, if it is desired to achieve either a Type IV pattern or a Type II pattern from the LED lighting unit 110, Type IV optics can be designed and populated in combination with corresponding LEDs in portions of the LED lighting unit 110 and Type II optics can be designed and populated in combination with corresponding LEDs in other portions of the LED lighting unit 110. Only the LEDs corresponding with the Type II optics may be illuminated to produce an overall full cut-off IES Type II distribution pattern and only the LEDs corresponding with the Type IV optics may be illuminated to produce an overall full cut-off IES Type IV distribution pattern. Also, all the LEDs may be illuminated to produce a combinational Type II and Type IV pattern.

In some embodiments each of the optical pieces may be manufactured as a single piece of acrylic, optionally utilizing standard injection molding procedures. In some embodiments each of the optical pieces may be placed in fixed relation to one of the LEDs 102 utilizing an adhesive that adheres the base 134 to a surface surrounding such LED 102. The LEDs 102 may be attached to a circuit board in some embodiments and/or may be attached to another surface in some embodiments. For example, in some embodiments the LEDs 102 may be directly attached to a heatsink.

The single piece shield array 120 is placeable over the individual optical pieces and includes a plurality of openings 126 that are each aligned with and each receive and surround one of the free form optics 132 and TIR prisms 133 of one of the optical pieces. The openings 126 may optionally be larger than the peripheries of the optical pieces in some embodiments. In some embodiments the openings 126 may be smaller than the peripheries of the optical pieces and the single piece shield array 120 may optionally rest atop the optical pieces. An intermediary outward facing surface 128 extends between and surrounds the openings 126. In some embodiments the outward facing surface 128 may be painted with and/or molded out of a flat black material to minimize any light reflection off the outward facing surface 128. Minimization of light reflection off the outward facing surface 128 may minimize the amount of any light from LEDs 102 that is incident thereon and directed in a stray direction away from the desired illumination direction. A plurality of fastener openings 121 are provided through the single piece shield array 120 and may receive screws or other fasteners therethrough for securing the single piece shield array 120 to a heatsink or other structure. A flange 129 extends downward from the outward facing surface 128 and may optionally surround an LED board or other mounting surface for the LEDs 102A.

A plurality of blocking shields 122 extend upward from and are provided partially over the openings 126 and optical pieces. Each of the blocking shields 122 includes a base 123 surrounding one of the openings 126 and an upper extent 124 opposite the base 123. Each of the blocking shields 122 has an interior surface 125 that is positioned and shaped to block any stray light emitted from an optical piece from being emitted in a back light direction opposite the desired illumination direction. The interior surface 125 is also positioned and shaped so as to not interfere with light emitted from the optical pieces that is directed in the desired illumination direction. The illustrated interior surface 125 is substantially dome shaped and has an arcuate cross section as taken from the base 123 to the upper extent 124 (e.g., as illustrated in FIG. 7). Each interior surface 125 extends completely over a TIR prism 133 and extends partially over (approximately 25% in the illustrated embodiment) free form optic 132. In some embodiments the interior surface 125 may be painted with and/or molded out of a flat black material to minimize any light reflection off the interior surface 125. Such painting and/or molding out of a flat black material may limit the reflection of any stray light from the optical pieces that is incident on the interior surface 125. In some embodiments the entirety of each blocking shield 122 may be painted with and/or molded out of a flat black material to minimize any light reflection off the interior surface 125.

Figure 9:
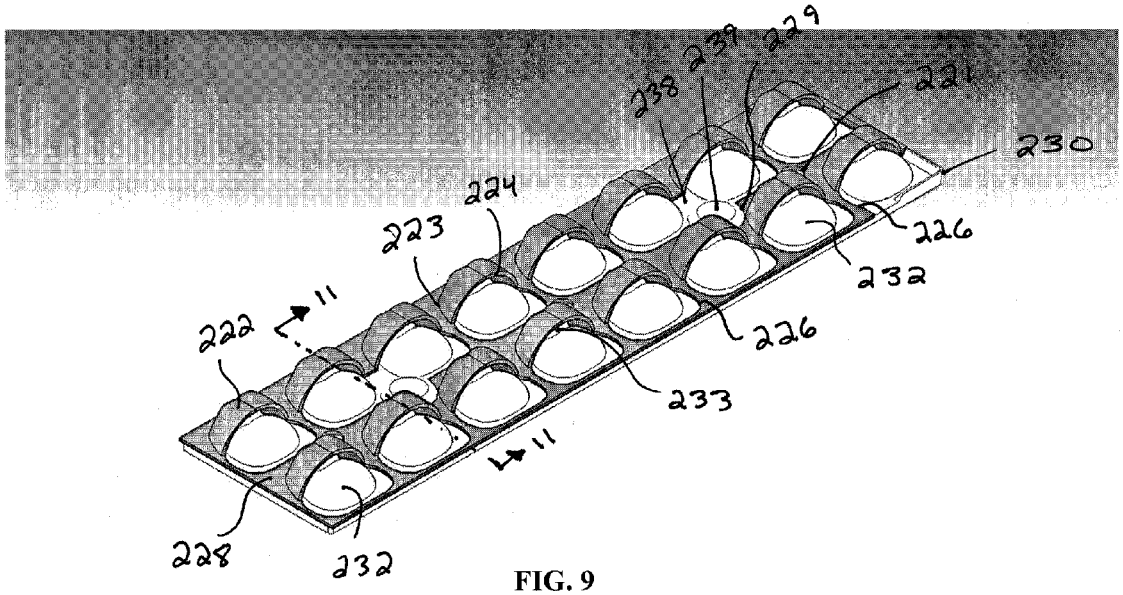
FIG. 9 illustrates a lower perspective view of a second embodiment of an LED optical system that may be utilized in a LED lighting unit.
Figure 10:
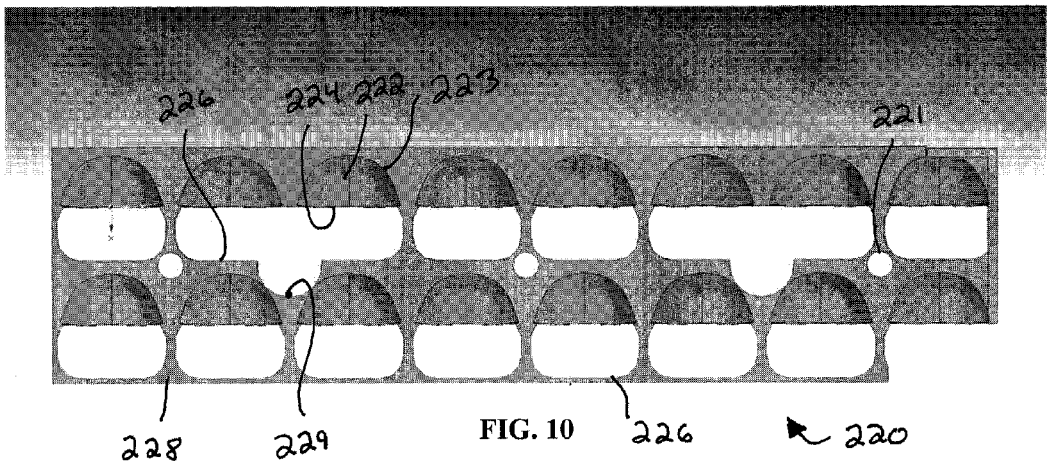
FIG. 10 illustrates a lower plan view of a single piece shield array of the second embodiment of the LED optical system.
Figure 11:
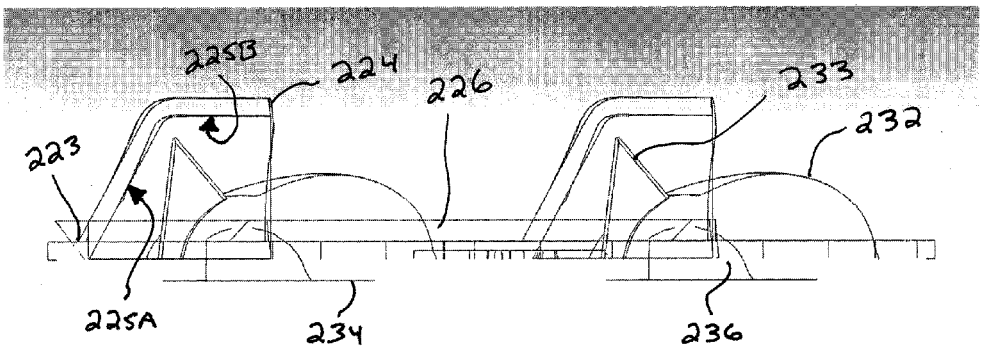
FIG. 11 illustrates a section view of the second embodiment of the LED optical system taken along the section line 11-11 of FIG. 9.

Referring to FIGS. 9 through 11, a second embodiment of a LED optical system is illustrated. The LED optical system includes a single piece shield array 220 and an array of optical pieces 230. The illustrated array of optical pieces 230 includes a plurality of individual optical pieces that are connected to one another and cohesively formed as a single piece. An intermediary outward surface 238 extends between the individual optical pieces and connects the optical pieces to one another. In some embodiments the individual optical pieces may be cohesively formed from a single piece of acrylic. Two columns of eight optical pieces are provided and may be positioned and aligned over a similarly arranged array of LEDs. In other embodiments one or more of the individual optical pieces may be separable from other of the optical pieces. For example, in other embodiments two separate cohesively formed optical piece arrays may be provided, each including a plurality of individual optical pieces. The individual optical pieces each include a free form optic 232 and a rear total internal reflection (TIR) prism 233. In the illustrated embodiment each of the individual optical pieces share a substantially common configuration. Also, each of the optical pieces is commonly oriented so that each of the optical pieces will direct light output from a LED it is provided over generally in the same illumination direction.

The free form optics 232 may be designed and populated in combination with LEDs to produce any desired distribution pattern. For example, the free form optics 232 may be designed to produce full cut-off Illumination Engineering Society (IES) patterns such as IES Type II, III, and/or IV full cut-off patterns. Each of the free form optics 232 is supported by the intermediary outward surface 238 and includes a LED cavity 236 (FIG. 11) on an inner facing side thereof. The LED cavities 236 are each positioned and sized to surround at least a portion of a single LED and direct light output therefrom through a respective free form optic 232. The illustrated LED cavities 236 have an arcuate profile on a side toward the desired illumination direction and a vertical profile on a side away from the desired illumination direction.

Optical design considerations and methodologies for the free form optics 232 may include those described in conjunction with free form optics 132. For example, the design may be selected based on a number of parameters such as the light output characteristics of the LEDs, the spacing of the LEDs, height constraints, the configuration of the LED cavities 236, and/or desired IES distributions. Each TIR prism 233 is placed on a backside of a free form optic 232 on an opposite side from the illumination direction of the free form optic 232. Each TIR prism 233 internally reflects a majority of light from a LED that is incident thereon back in the illumination direction. The LED recess 236, the free form optic 232, and the TIR prism 233 cooperatively work together to direct a substantial majority of light output generated by a LED that they are provided over generally in the illumination direction.

Although a specific placement of specific optical pieces are illustrated herein, one of ordinary skill in the art, having had the benefit of the present disclosure, will recognize and appreciate that alternative and/or additional optical pieces may be designed to produce a desired light output and/or to interface with one or more particular LEDs. Moreover, differing placement of the optics illustrated herein and/or alternative optics may be utilized to achieve a desired light output and/or to interface with one or more particular LEDs. In some embodiments each of the optical pieces may be placed in fixed relation to one of a plurality of LEDs of a lighting unit utilizing an adhesive that adheres the array of optical pieces 230 (e.g., via contact with base 234) to one or more surface supporting such LEDs.

The single piece shield array 220 is placeable over the individual optical pieces and includes a plurality of openings 226 that are each aligned with and each receive and surround one of the free form optics 232 and TIR prisms 233 of one of the optical pieces. The openings 226 are slightly larger than the peripheries of the free form optics 232 and TIR prisms 233. The single piece shield array 220 rests atop the intermediary outward surface 238. An intermediary outward facing surface 228 of the shield array 220 extends between and surrounds the openings 226. In some embodiments the outward facing surface 228 may be painted with and/or molded out of a flat black material to minimize any light reflection off the outward facing surface 228. Minimization of light reflection off the outward facing surface 228 may minimize the amount of any light from LEDs that is incident thereon and directed in a stray direction away from the desired illumination direction. A plurality of fastener openings 221 are provided through the single piece shield array 220 and may receive screws or other fasteners therethrough for securing the single piece shield array 220 to a heatsink or other structure. The securing of the single piece shield array 220 by the screws to a surface will also compressively secure the array of optical pieces 230 between the surface and the single piece shield array 220.

A plurality of blocking shields 222 extend upward from and are provided partially over the openings 226 and optical pieces. Each of the blocking shields 222 includes a base 223 surrounding one of the openings 226 and an upper extent 224 opposite the base 223. Each of the blocking shields 222 has an interior surface that is positioned and shaped to block any stray light emitted from an optical piece from being emitted in a back light direction opposite the desired illumination direction. The interior surface is also positioned and shaped so as to not interfere with light emitted from the optical pieces that is directed in the desired illumination direction. The illustrated interior surface 225 has an angled substantially flat rear portion 225A as viewed in cross section as taken from the base 223 to the upper extent 224 (e.g., as illustrated in FIG. 11). The illustrated interior surface also has a substantially flat upper portion 225B as viewed in cross section as taken from the base 223 to the upper extent 224 (e.g., as illustrated in FIG. 11). The upper portion 225B and the angled rear portion 225A are at approximately a one-hundred and twenty degree angle relative to one another. The upper portion 225B is substantially co-planar with the outward facing surface 228. Each interior surface extends completely over a TIR prism 233 and extends partially over (approximately 25% in the illustrated embodiment) free form optic 232. In the illustrated embodiment each angled rear portion 225A extends approximately to a TIR prism 233 and each upper portion 225B extends approximately from the TIR prism 233 and over approximately 25% of a corresponding free form optic 232. In some embodiments the interior surface 225 may be painted with and/or molded out of a flat black material to minimize any light reflection off the interior surface 225. Such painting and/or molding out of a flat black material may limit the reflection of any stray light from the optical pieces that is incident on the interior surface 225. In some embodiments the entirety of each blocking shield 222 may be painted with and/or molded out of a flat black material to minimize any light reflection off the interior surface 225.

The intermediary outward surface 238 of the array of optical pieces 230 includes two alignment protrusions 239 extending upward therefrom. The alignment protrusions are received in corresponding alignment notches 229 of the single piece shield array 220. The alignments protrusions 239 and notches 229 may assist in appropriately aligning the single piece shield array 220 over the array of optical pieces 230.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An optical system adapted for placement on an array of LEDs, said optical system comprising:

an array of optical pieces, each including:

a first side having formed therein a cavity for receiving at least a portion of a respective one of said LEDs; and a second side opposite the first side and having a first portion positioned and configured to direct emitted light received from the respective LED in a predetermined desired illumination direction and a second portion positioned and configured to redirect stray light emitted by said respective LED, but not received by said first portion, in said predetermined desired illumination direction; and a shield array placed over said array of optical pieces, said shield array including a plurality of openings sized to receive respective ones of said optical pieces and including a plurality of blocking shields, each extending upward from and partially over one of said openings and partially over a respective one of said optical pieces, to block stray emitted light directed generally opposite to said predetermined desired illumination direction, where the second portion of the second side of each of said optical pieces includes a total internal reflection prism arranged to effect said redirection of stray light emitted by said respective LED.

2. The optical system of claim 1 where each of the blocking shields includes a non-reflective interior surface generally facing the respective optical piece.

3. The optical system of claim 2 where the interior surface of each of said blocking shields is black.

4. The optical system of claim 1 where the shield array includes a non-reflective outer surface.

5. The optical system of claim 1 where each of said optical pieces is shaped and arranged to form the light directed in the predetermined desired illumination direction into a predetermined distribution pattern.

6. The optical system of claim 1 where the array of optical pieces comprises a plurality of optical pieces that are integrally connected to each other.

7. The optical system of claim 1 where the total internal reflection prism of each of said optical pieces is positioned completely under the blocking shield associated with the respective optical piece.

8. The optical system of claim 1 where the array of optical pieces comprises a plurality of separate optical pieces that can be individually positioned and aligned over a respective one of the LEDs.

9. The optical system of claim 1 where each of said blocking shields includes an interior surface generally facing a respective one of said optical pieces and extending partially over said optical piece.

10. The optical system of claim 1 where said optical array includes at least one alignment protrusion extending into a corresponding alignment notch provided in said shield array.

11. An LED lighting unit comprising:

an array of LEDs;

an array of optical pieces, each including:

a first side having formed therein a cavity positioned over a respective one of said LEDs; and a second side opposite the first side and having a first portion positioned and configured to direct emitted light received from the respective LED in a predetermined desired illumination direction and a second portion positioned and configured to redirect stray light emitted by said respective LED, but not received by said first portion, in said predetermined desired illumination direction;

a shield array placed over said array of optical pieces, said shield array including a plurality of openings, each sized to receive respective ones of said optical pieces, and including a plurality of blocking shields, each extending upward from and partially over one of said openings and partially over a respective one of said optical pieces, to block stray emitted light directed generally opposite to said predetermined desired illumination direction, where the second portion of the second side of each of said optical pieces includes a total internal reflection prism arranged to effect said redirection of stray light emitted by said respective LED.

12. The LED lighting unit of claim 11, where each of the blocking shields includes a non-reflective interior surface generally facing the respective optical piece.

13. The LED lighting unit of claim 11, where the shield array includes a non-reflective outer surface.

14. The LED lighting unit of claim 11, where each of said optical pieces is shaped and arranged to form the light directed in the predetermined desired illumination direction into a predetermined distribution pattern.

15. The LED lighting unit of claim 14 where said optical array includes at least one alignment protrusion extending into a corresponding alignment notch provided in said shield array.

16. The LED lighting unit of claim 11 where the array of optical pieces comprises a plurality of optical pieces that are integrally connected to each other.

17. The LED lighting unit of claim 11 where the total internal reflection prism of each of said optical pieces is positioned completely under the blocking shield associated with the respective optical piece.

18. The LED lighting unit of claim 11 where the array of optical pieces comprises a plurality of separate optical pieces that can be individually positioned and aligned over a respective one of the LEDs.

* * * * *